US008662032B2

(12) United States Patent
Pohjalainen

(10) Patent No.: US 8,662,032 B2
(45) Date of Patent: Mar. 4, 2014

(54) CYLINDER PRESSURE ADJUSTER OF A MOTOR

(76) Inventor: Aulis Pohjalainen, Kerimaki (FI)

( * ) Notice: Subject to any disclaimer, the term of this patent is extended or adjusted under 35 U.S.C. 154(b) by 34 days.

(21) Appl. No.: 13/391,182

(22) PCT Filed: Jun. 23, 2010

(86) PCT No.: PCT/FI2010/000043

§ 371 (c)(1),
(2), (4) Date: Feb. 17, 2012

(87) PCT Pub. No.: WO2011/020943

PCT Pub. Date: Feb. 24, 2011

(65) Prior Publication Data

US 2012/0144997 A1 Jun. 14, 2012

(30) Foreign Application Priority Data

Aug. 17, 2009 (FI) ..... 20090300

(51) Int. Cl.
*F02B 75/04* (2006.01)

(52) U.S. Cl.
USPC ..... 123/78 A; 123/78 B; 123/78 BA

(58) Field of Classification Search
USPC ..... 123/78 E, 78 F; 91/508–536
See application file for complete search history.

(56) References Cited

U.S. PATENT DOCUMENTS

| | | | | |
|---|---|---|---|---|
| 5,908,014 | A * | 6/1999 | Leithinger | 123/78 F |
| 6,202,623 | B1 * | 3/2001 | Ehrlich | 123/197.4 |
| 6,588,384 | B2 * | 7/2003 | Yapici | 123/78 F |
| 7,174,865 | B2 * | 2/2007 | Sakita | 123/78 F |

* cited by examiner

*Primary Examiner* — Lindsay Low
*Assistant Examiner* — Syed O Hasan
(74) *Attorney, Agent, or Firm* — Shaukat A. Karjeker; Colin P. Cahoon; Carstens & Cahoon, LLP

(57) ABSTRACT

A crank device and an adjusting device of a combustion engine. The system adjusts the cylinder pressure of the motor in accordance with the required power. Adjustment of the cylinder pressure takes place by changing the compression ration by means of the adjusting device (19). The adjusting device (19) changes an eccentric wheel (3) through an adjusting wheel (4) to a such position that a connecting rod (2) lifts a piston (1) to a desired distance from the combustion chamber head. The adjusting device measures the volume of the air entering the cylinder and adjust the compression ratio to be appropriate. The adjusting device also takes into account the speed of rotation so that the compression pressure increases or decreases to be appropriate.

13 Claims, 1 Drawing Sheet

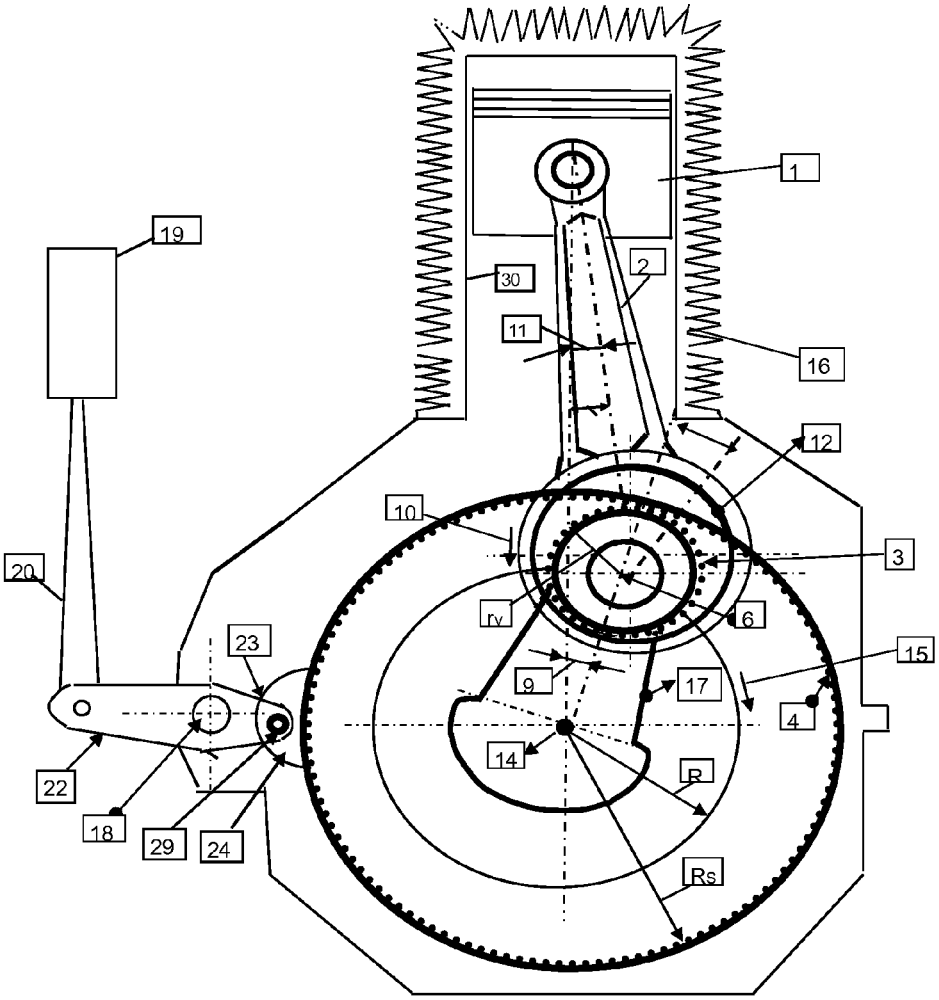
1
19
30
2
11
16
12
10
3
20
rv
6
23
15
9
17
4
14
R
22
18
29
24
Rs

CYLINDER PRESSURE ADJUSTER OF A MOTOR

BACKGROUND OF THE INVENTION

1. Technical Field

The present invention relates to a motor which comprises a motor compression pressure adjuster and wherein a connecting rod is provided extends from a piston of the motor toward a crank arm. The connecting rod is mounted via bearings to an eccentric wheel, and the eccentric wheel is provided with a gear ring. The gear ring is centered on the crank arm and the eccentric wheel is driven by an adjusting wheel.

2. Background of the Invention

In the known motors a connecting rod is mounted on bearings on a crank arm shaft. When a piston is in the top position the combustion chamber is the same in the entire rotation speed range. With short filling the compression pressure remains low resulting in substantially poor performance.

When the speed of rotation increases the combustion chamber increases relatively quicker than on low speeds. Because of this the pressure in the cylinder does not increase on a sufficiently high level and this decreases the power of the motor.

In conventional motors when the piston is in the upper dead centre the crank arm and the connecting rod are on the same line and the length of the lever is zero. Therefore the torque is also temporarily zero.

SUMMARY OF THE INVENTION

The invention aims to remove the above mentioned disadvantages and provide a motor which has substantially lower loss of thermal energy, increased output per liter and which decreases CO2 emissions about 38% compared to conventional motors.

This aim can be achieved in accordance with the invention by using a compression pressure adjuster and by it use an adjusting wheel 4 to adjust the position of an eccentric wheel on the crank arm shaft.

Gearwheels shall be dimensioned by means of the equation on page 2. An eccentric wheel is mounted on bearings at the lower end of the connecting rod and in the crank arm. The eccentric wheel has a fixed gear ring 3 positioned centrally on the crank arm shaft. The gear ring 3 is driven by the adjusting wheel 4. A computer and an adjusting device 19 move the adjusting wheel 4 to a position required by a sufficient cylinder pressure.

When the adjusting device 19 moves the adjusting wheel 4 counter clockwise the combustion chamber decreases and the pressure increases. Correspondingly, the pressure remains lower when the adjusting wheel is turned clockwise.

More particularly, the motor in accordance with the invention comprises a motor compression pressure adjuster and wherein a connecting rod is provided from a piston of the motor to the direction of a crank arm, the connecting rod being mounted by bearings to an eccentric wheel, wherein the eccentric wheel is provided with a gear ring that is centred on the crank arm and the eccentric wheel is driven by an adjusting wheel, and the eccentric wheel and adjusting wheel are dimensioned so that the radius of the crank arm+the rolling radius of the gear ring of the eccentric wheel=rolling radius of the adjusting wheel.

BRIEF DESCRIPTION OF THE DRAWINGS

In the following, the invention is described in more detail with reference to the annexed drawings, which show in sectioned drawings a motor construction in accordance with the invention.

FIG. 1 is a schematic representation of one embodiment of the present invention.

DETAILED DESCRIPTION

Part 2 of a motor is manufactured of metal so that it allows mounting of the crank shaft end thereof about an eccentric wheel 12. A gear ring 3 centered on a crank journal 6 of the crank arm is fixed in the eccentric wheel 12. The gear ring 3 of the eccentric wheel 12 is in contact with the gear ring of the adjusting wheel 4.

The adjusting wheel 4 is mounted on the body of the motor such that it can be turned back and forth in the range of 0-30°. To turn the adjusting wheel 4 it is provided with a turning shoulder 24 to which a swinging arm 22 is attached.

The swinging arm 22 is fixed to a shaft 18. Turning apparatus are attached to the shaft 18 for turning each adjusting gear ring.

The adjusting device 19 takes into account the speed of rotation, required power and filling ratio of the motor.

The eccentric wheel 12 rotates in a direction 10 opposite to the rotation 15 of the crank shaft 17 of the motor about axis 14. The rolling radius ry of the gear ring 3 of the eccentric wheel 12 and the rolling radius Rs of the adjusting gear ring 4 are dimensioned such that $Rs=R+rv=2.5\times rv$.

The moving wheel 4 of each cylinder is moved by shaft 18 and the therein fixed swinging arms 22. By means of this the adjustment is provided simultaneously in each cylinder.

The system provides a greater angle 11 of the connecting rod 2 and 9 of the crank arm in the beginning of the combustion stroke thereby increasing the leverage arm. Further, and correspondingly, at the end of the combustion stroke it decreases the angle 11 of the connecting rod 2 and decreases the friction between the piston 1 and the cylinder wall 30 of the cylinder 16.

In case of short filling the combustion chamber decreases and the distance to the fire front is shortened as is the time of fire. The shorter time of fire and greater compression ratio provide sufficiently high pressure in the cylinder.

In greater rotation speeds the cylinder pressure is increased by changing the compression ratio. The structure provides a greater piston speed and higher cylinder pressure during the combustion stroke. The combustion chamber increases rapidly and the pressure does not increase too much.

By changing the combustion chamber the pressure in the cylinder is adjusted to the knocking border and the temperature as high as the structure of the motor allows. The high temperature increases resistance to thermal conductivity and thereby losses in thermal energy can be decreased.

The invention claimed is:

1. A motor comprising:

a crankshaft, a cylinder, a piston in the cylinder and a connecting rod for connecting the piston and the crankshaft, an eccentric wheel rotationally mounted on a crank journal of the crankshaft, and provided with a first gear ring centered on the crank journal, the connecting rod being rotationally mounted on the respective eccentric wheel, a second gear ring concentrically mounted around an axis of the crankshaft, the second gear driving the first gear ring such that rolling of the first gear ring rotates the eccentric wheel around the crank journal, a turning arm pivotally connected to the second gear ring for adjusting the position of the second gear ring around the crankshaft axis, and a compression pressure adjuster configured to adjust a position of the second gear ring by moving the turning arm.

2. A motor in accordance with claim 1, wherein a rolling radius of the second gear ring is about 2.5 times a rolling radius of the first gear ring of the eccentric wheel.

3. A motor in accordance with claim 1, wherein the compression pressure adjuster is configured to adjust the second gear ring into a desired position by means of a shifting arm and the turning arm.

4. A motor in accordance with claim 1, wherein the turning arm is arranged to pivot around an adjustment shaft.

5. A motor in accordance with claim 4, wherein the adjustment shaft is adapted to turn the second gear ring of the cylinder.

6. A motor in accordance with claim 1, wherein the pivoting connection of the turning arm and the second gear ring comprises a turning shoulder.

7. A motor in accordance with claim 6, further comprising a shock absorber for absorbing shocks at the turning shoulder.

8. A motor in accordance with claim 1, wherein the compression pressure adjuster is adapted to process information about a filling ratio of the cylinder, speed of rotation and required power.

9. A motor in accordance with claim 8, wherein the compression pressure adjuster is adapted to change a compression ratio to provide an optimal compression pressure in the cylinder.

10. A method for adjusting compression pressure in a cylinder of a motor where a connecting rod is mounted by bearings to an eccentric wheel on a crank journal of a crankshaft and the eccentric wheel is provided with a first gear ring centered on the crank journal, the first gear ring engaging with teeth of a second gear ring concentrically mounted around an axis of the crankshaft, the method comprising adjusting the position of the eccentric wheel relative to the crank journal by turning the second gear ring by means of a turning arm pivotally attached to the second gear ring.

11. A method as claimed in claim 10, wherein a rolling radius of the teeth of the second gear ring is about 2.5 times a rolling radius of the first gear ring of the eccentric wheel.

12. A method as claimed in claim 10, further comprising adjusting the position of the eccentric wheel by pivoting the turning arm about an adjustment shaft.

13. A method in accordance with claim 12, comprising adjusting positions of a plurality of eccentric wheels by turning the turning arm about the adjustment shaft.

* * * * *